US006450578B1

(12) United States Patent
Taggett

(10) Patent No.: US 6,450,578 B1
(45) Date of Patent: Sep. 17, 2002

(54) ERGONOMIC CHAIR

(76) Inventor: Michael Blake Taggett, P.O. Box 16350, Wichita, KS (US) 67216

( * ) Notice: Subject to any disclaimer, the term of this patent is extended or adjusted under 35 U.S.C. 154(b) by 0 days.

(21) Appl. No.: 09/642,179

(22) Filed: Aug. 18, 2000

(51) Int. Cl.[7] ..... A47C 1/035; A47C 1/024

(52) U.S. Cl. ..... 297/325; 297/173; 297/174; 297/341; 297/342; 297/344.18; 297/423.38

(58) Field of Search ..... 297/325, 174, 297/173, 342, 341, 423.38, 344.18

(56) References Cited

U.S. PATENT DOCUMENTS

| | | | | | |
|---|---|---|---|---|---|
| 488,707 | A | * | 12/1892 | Cloutier | 297/328 |
| 491,098 | A | * | 2/1893 | Gould | 297/328 |
| 3,232,575 | A | * | 2/1966 | Ferro | 297/430 |
| 4,101,168 | A | * | 7/1978 | Ferro | 297/329 |
| 4,383,714 | A | * | 5/1983 | Ishida | 297/325 |
| 4,736,523 | A | | 4/1988 | Roossien et al. | |
| 4,767,160 | A | * | 8/1988 | Mengshoel et al. | 297/423.12 |
| 4,790,599 | A | * | 12/1988 | Goldman | 297/327 |
| 4,925,240 | A | * | 5/1990 | Peters | 297/161 |
| 4,957,302 | A | * | 9/1990 | Maxwell | 280/32.6 |
| 5,098,160 | A | | 3/1992 | Moore et al. | |
| 5,261,723 | A | | 11/1993 | Hosoe | |
| 5,261,725 | A | | 11/1993 | Rudolph | |
| 5,330,254 | A | | 7/1994 | Larson | |
| 5,374,102 | A | | 12/1994 | Archambault et al. | |
| 5,540,160 | A | | 7/1996 | Rea | |
| 5,662,381 | A | | 9/1997 | Roossien et al. | |
| 5,765,910 | A | | 6/1998 | Larkin et al. | |
| 5,836,555 | A | | 11/1998 | Ellsworth et al. | |
| 5,951,105 | A | | 9/1999 | Slettebo | |
| 5,967,609 | A | * | 10/1999 | Potter | 297/325 |
| 5,971,481 | A | | 10/1999 | Emmenegger et al. | |
| 5,984,408 | A | | 11/1999 | Bujaryn | |
| 6,022,071 | A | | 2/2000 | Smith | |
| 6,056,363 | A | * | 5/2000 | Maddox | 297/325 |

* cited by examiner

*Primary Examiner*—Peter M. Cuomo
*Assistant Examiner*—Joseph Edell
(74) *Attorney, Agent, or Firm*—Robert Blinn

(57) ABSTRACT

The ergonomic chair of the present invention provides a seating system that allows an occupant, while seated, to shift his or her position while exercising major muscle groups. The present invention chair includes a seat support frame that supports a seatrest and a backrest. The seatrest and the backrest are connected so that they can pivot relative to each other. The backrest of the invention chair can move along backrest tracks mounted to the frame between a lower resting position and a raised extended position. Because the seatrest is hinged to the backrest, it moves with the backrest by translating and rotating in relation to the frame. The seatrest is supported by the seat support frame so that the seatrest can slide and rotate in relation to the seat support frame. The occupant of the invention chair can push against the backrest, translate the backrest along the backrest tracks, stretch out into the extended position and then return to the resting position.

16 Claims, 6 Drawing Sheets

ERGONOMIC CHAIR

FIELD OF THE INVENTION

This invention relates to an ergonomic adjustable chair and more particularly to an ergonomic adjustable chair wherein the occupant can move between a resting position and an extended position.

BACKGROUND OF THE INVENTION

Much attention has been paid to the proper positioning and maintenance of the human body in a seated position. The patent literature discloses numerous seating devices directed to achieve various ergonomic objectives. For example, U.S. Pat. Nos. 482,745, 488,707 and 491,098 teach barber and dental chairs having integral foot supports. U.S. Pat. No. 4,369,997 discloses an articulated chair having an elevated seat surface and footrest. In U.S. Pat. No. 4,369,997, a seat surface and an interconnected footrest and a backrest may be adjusted from a position in which the seat surface is almost horizontal to an inclined position where the seat surface functions as a standing rest. U.S. Pat. No. 5,098,160 issued to Moore et al. describes a structure for adjustably positioning a footrest relative to an office chair.

While the foregoing seating and support devices provide ergonomic seating in various task specific applications, none of the seating and support devices found in the prior art provide a means to allow an occupant to stretch into an extended position and thereby stretch and exercise major muscle groups while staying in a generally seated position. Further, the prior art does not provide a way to actively support the lower back while the occupant shifts or changes his or her position.

SUMMARY OF THE INVENTION

The ergonomic chair of the present invention provides a seating system that allows the occupant, while seated, to shift his or her position while exercising major muscle groups and while benefiting from continuous lower back support. The ergonomic chair of the present invention includes a base and a seat support frame that supports a seatrest and a backrest. The seatrest and the backrest as connected so that they can pivot relative to each other. The backrest of the chair is slidably mounted to a pair of backrest tracks that are mounted to the seat support frame. The backrest is slidably mounted to the backrest tracks so that it can move along the backrest tracks between a lower resting position and a higher extended position. The seatrest which is hinged to the backrest slides and rotates relative to the seat support frame when the backrest is moved into the extended position.

The ergonomic chair of the present invention provides a seating system that allows the occupant, while seated, to shift his or her position while exercising major muscle groups and while benefiting from continuous lower back support. The ergonomic chair of the present invention includes a base and a seat support frame that supports a seatrest and a backrest. The seatrest and the backrest as connected so that they can pivot relative to each other. The backrest of the chair is slidably mounted to a pair of backrest tracks that are mounted to the seat support frame. The backrest is slidably mounted to the backrest tracks so that it can move along the backrest tracks between a lower resting position and a higher extended position. The seatrest which is hinged to the backrest slides and rotates relative to the seat support frame when the backrest is moved into the extended position.

With the addition of a footrest that is rigidly attached to the seat support frame, an occupant of the chair can push against the footrest and translate the backrest and the seatrest from a resting position into an extended position. After pushing up into an extended position, the occupant can by relaxing pressure against the footrest, allow the backrest and the seatrest to return to the resting position.

When an occupant is seated in a chair of the present invention having a properly located footrest, the stress placed on the lower back of the occupant as a result of being seated for a long period of time is greatly reduced. The occupant can stretch and exercise as described above. The chair of the present invention is also designed so that the backrest can provide constant lower back support even when the backrest is being translated into the extended position. The chair of the present invention even provides lower back support even when the occupant shifts or changes position.

DETAILED DESCRIPTION OF THE INVENTION

Figure 1:
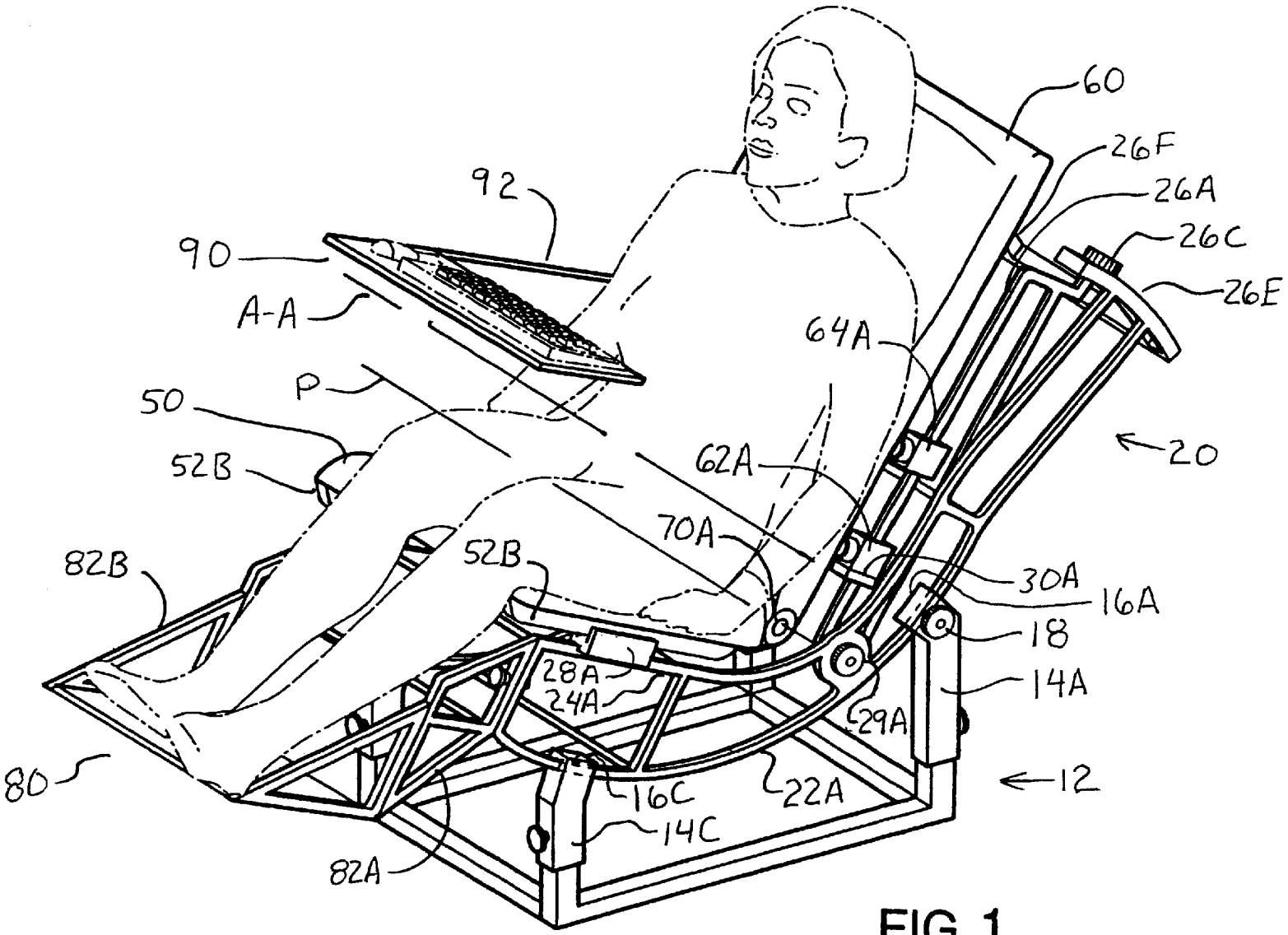
FIG. 1 is a perspective view of the ergonomic chair of the present invention shown with an occupant.

FIG. 1 shows an ergonomic chair according to the present invention that is generally indicated by the reference numeral 10. Chair 10 includes a base 12, a frame 20, a seatrest 50, a backrest 60, a footrest assembly 80 and a keyboard table 90.

Figure 2:
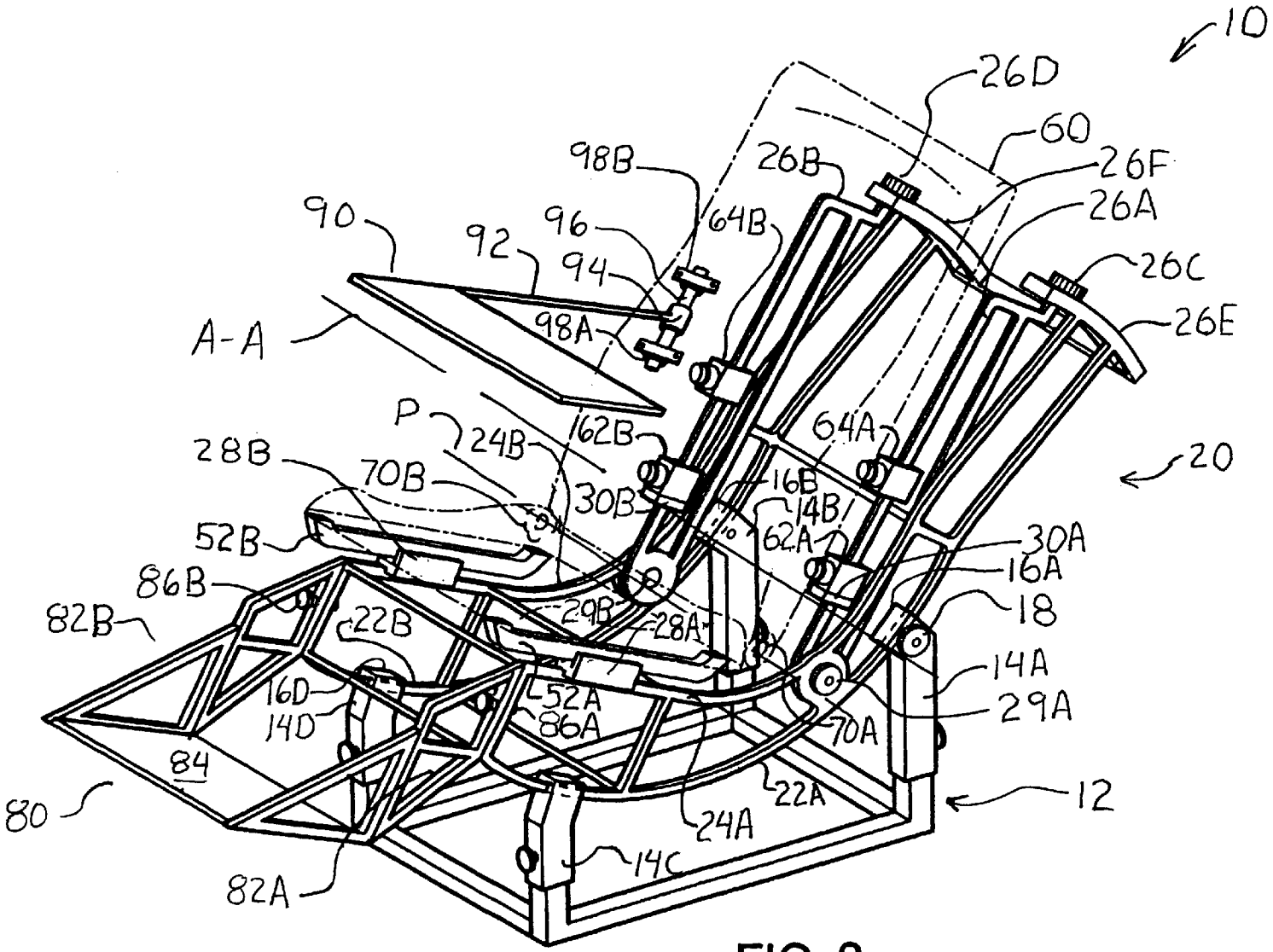
FIG. 2 is a perspective view of the ergonomic chair of the present invention shown without an occupant and shown with seatrest 50 and backrest 60 in phantom.
Figure 3:
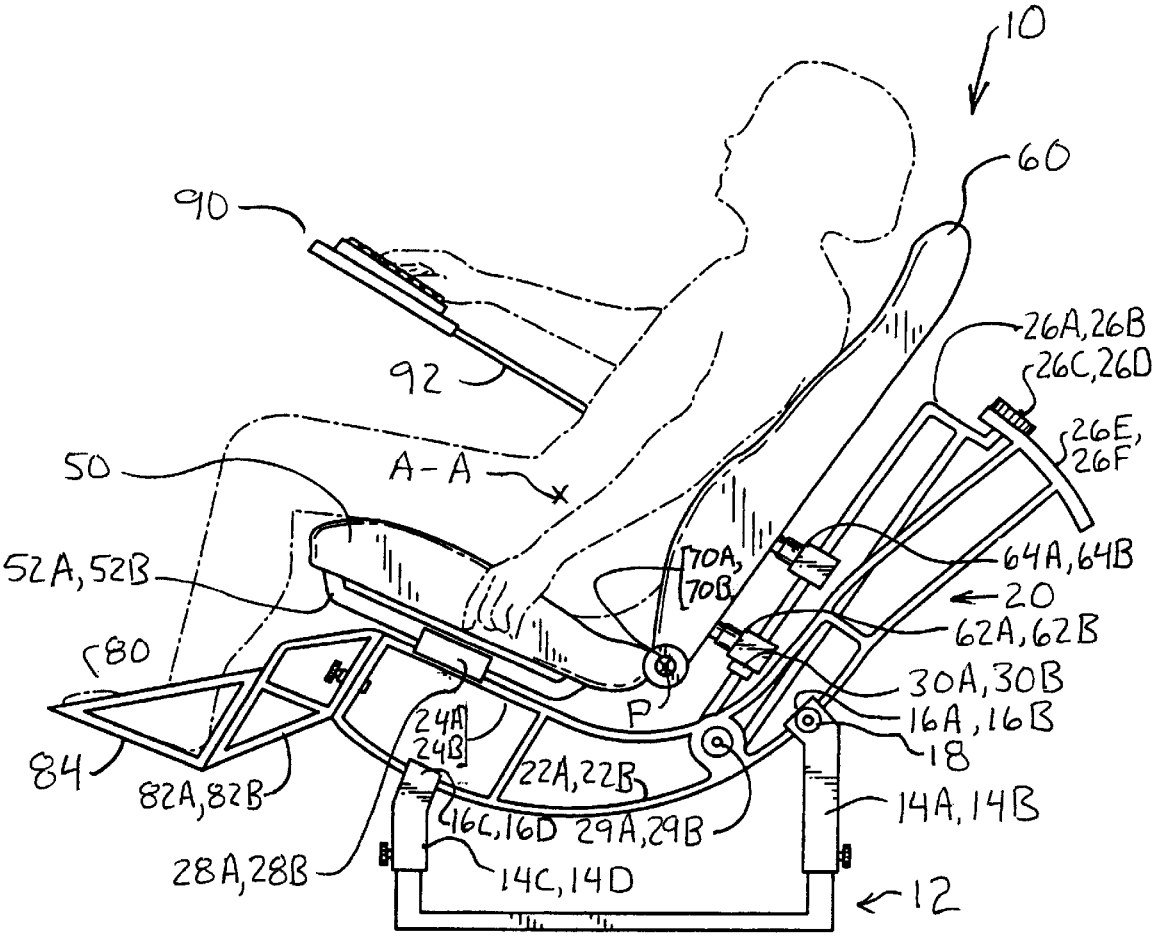
FIG. 3 is a side view of the ergonomic chair of the present invention shown with an occupant and shown in the first resting position.

As shown in FIG. 1 and FIG. 2, base 12 supports chair 10 and includes four telescoping columns 14A, 14B, 14C and 14D. Frame 20 includes two arc shaped outer members 22A and 22B and two inner members 24A and 24B. Outer members 22A and 22B and inner members 24A and 24B are interconnected by other structural members that complete a rigid structure. Frame 20 also includes backrest tracks 26A and 26B which can be either part of or mounted to frame 20 in a fixed manner or can be adjustably mounted to frame 20 as shown in FIG. 1, FIG. 2 and FIG. 3. Fixed to inner members 24A and 24B of frame 20 are slotted fittings 28A and 28B for receiving seatrest 50. Seatrest 50 includes seatrest tracks 52A and 52B that are adapted to slide within slotted fittings 28A and 28B.

Seatrest 50 and backrest 60 are connected to each other by joints 70A and 70B that pivot about a pivot axis P shown in FIG. 2. Joints 70A and 70B are preferably configured to maintain at least a 90 degree angle between seatrest 50 and backrest 60. Translating members engage backrest 60 with backrest tracks 26A and 26B. These translating members must be able to move up and down backrest tracks 26A and 26R and must also be adjustable because the angle between backrest tracks 26A and 26B and backrest 60 can be adjusted and fixed at different angles. In the preferred embodiment, lower linear bearings 62A and 62B and upper linear bearings 64A and 64B are the translating members that engage backrest 60 with backrest tracks 26A and 26B. Lower linear bearings 62A and 62B and upper linear bearings 64A and 64B all move on backrest tracks 26A and 26B. Backrest stops 30A and 30B fixed to back rest tracks 26A and 26B prevent lower linear bearings 62A and 62B from sliding below a predetermined point.

Backrest tracks 26A and 26B are mounted to frame 20 by a pair of backrest track joints 29A and 29B and by a pair of backrest track locks 26C and 26D that engage radial brackets 26E and 26F fixed to seat support frame 20. The position of backrest tracks 26A and 26B can be adjusted relative seat support frame 20 by unlocking them from radial brackets 26E and 26F and rotating them about backrest track joints 29A and 29B to a second position. FIG. 5 shows backrest tracks 26A and 26B in a second position. When the angle of backrest tracks 26A and 26B in relation to frame 20 is adjusted as shown in FIG. 5, then lower linear bearings 62A and 62B and upper linear bearings 64A and 64B must be connected to backrest 60 by members that allow adjustments in the angles and positions of the bearings relative to backrest 60. Although, any one of a number of mechanisms can be selected to provide adjustable positioning of lower linear bearings 62A and 62B and upper linear bearings 64A and 64B in relation to backrest 60, the preferred embodiment shown in FIG. 1, FIG. 2, FIG. 3, FIG. 4 and FIG. 5 employs pivoting bearings mounted within telescoping members that can be extended and locked in position. The telescoping members and the pivoting bearings of lower linear bearings 62A and 62B and upper linear bearings 64A and 64B make it possible to adjust the angle of backrest tracks 26A and 26B while holding the angle between seatrest 50 and backrest 60 constant.

Figure 5:
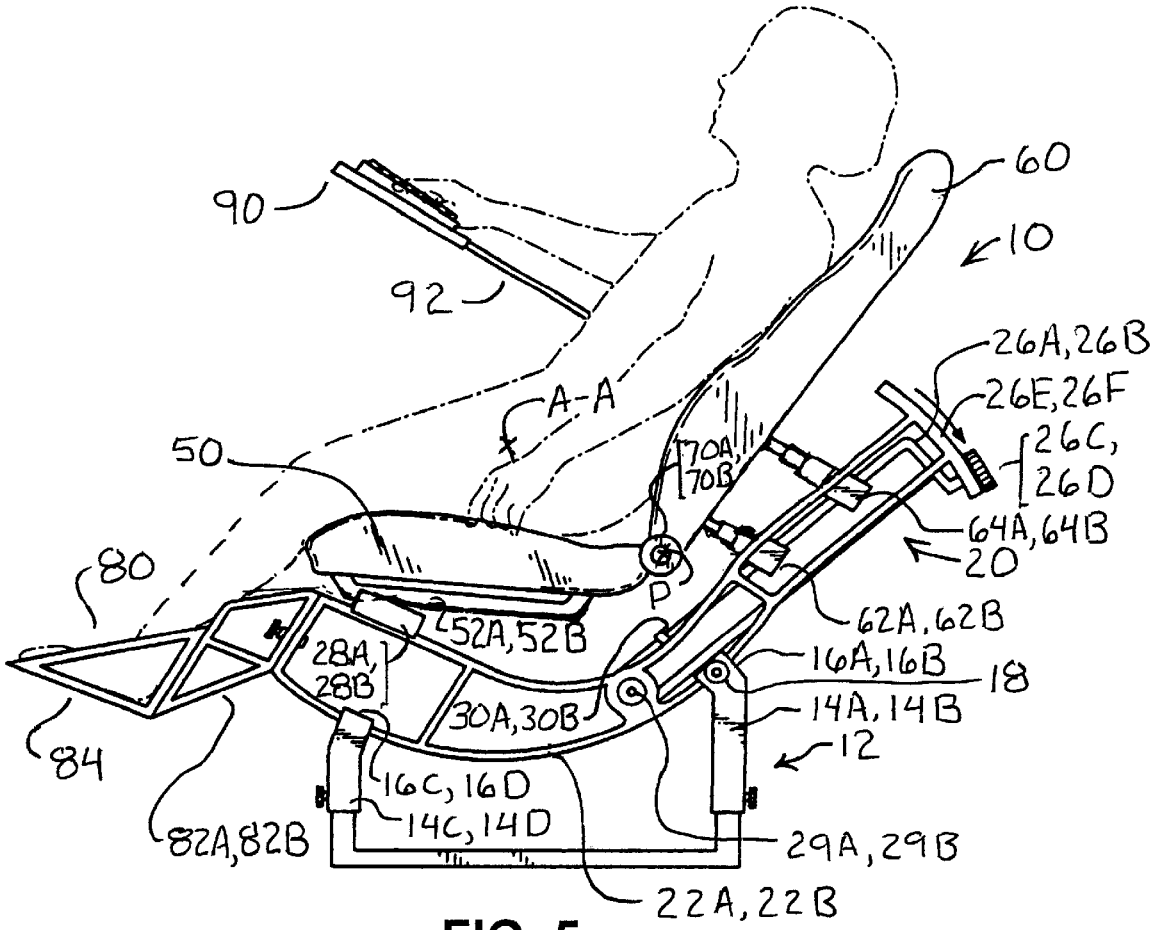
FIG. 5 is a side view of the ergonomic chair of the present invention shown with an occupant and shown in the second extended position with the backrest tracks in a second position at an angle to the backrest.
Figure 5A:
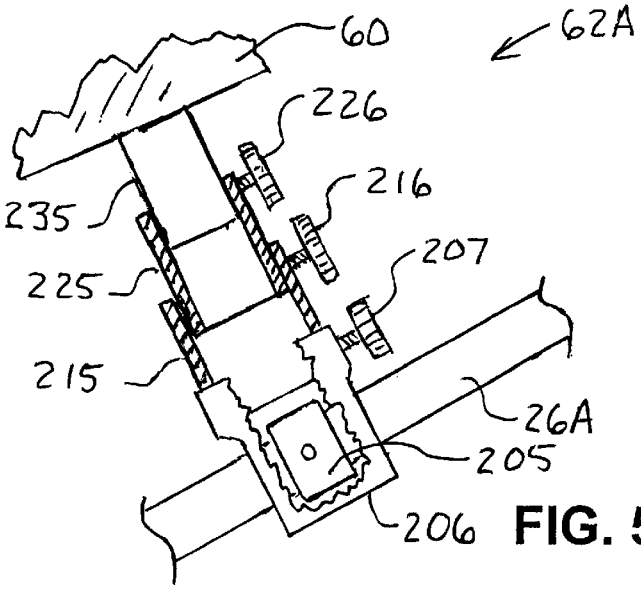
FIG. 5A is a magnified, sectional view of a lower linear bearing.

For further illustration, FIG. 5A provides a magnified, sectional view of lower linear bearing 62A. Lower linear bearing 62A is substantially identical to lower linear bearings 62B and upper linear bearings 64A and 64B. As can be seen in FIG. 5A, lower linear bearing 62A includes a base element 205 that pivotably carries a bearing 206 and has a slot (not shown) for clearing backrest track 26A. Bearing 206 is sized to slide along backrest track 26A. A first telescoping element 215, a second telescoping element 225 and a third telescoping element 235 extend away from base element 205 and can be locked in position by first lock 207, second lock 216 and third lock 226. Telescoping element 235 is rigidly attached to backrest 60. As can be seen in FIG. 5A, lower linear bearing 62A can be extended and locked in a fixed position.

As is shown in FIG. 1, FIG. 2 and FIG. 3, base 12 includes four telescoping columns 14A, 14B, 14C and 14D which can be raised or lowered in unison to adjust the overall height of chair 10. At the top of each of telescoping columns 14A, 14B, 14C and 14D are fittings 16A, 16B, 16C and 16D for receiving a portion of outer member 22A or 22B. Outer members 22A and 22B describe circular arcs that are centered upon axis A—A shown in FIG. 1, FIG. 2 and FIG. 3. The location for axis A—A can vary, but generally, axis A—A should be parallel to pivot axis P that rune through the center of joints 70A and 708 that hinge seatrest 50 and backrest 60. Since outer members 22A and 22B are arc shaped, they can be moved back and forth within fittings 16A, 16B, 16C and 16D to adjust the overall angle of chair 10. At least one fitting lock 18 can be used to lock the position of frame 20 with respect to base 12. The height adjustment provided by telescoping columns 14A, 14B, 14C and 14D and the angle adjustment provided fittings 16A, 16B, 16C and 16D as described above are present in the preferred embodiment, however, it may be possible to practice the invention without these adjustments.

As shown in FIG. 1, FIG. 2 and FIG. 3, footrest assembly 80 is mounted to seat support frame 20. Footrest assembly 80 includes a footrest pan 84 and two support arms 82A and 82B. The position of footrest assembly 80 in relation to frame 20 can be adjusted at adjustable joints 86A and 86B. Although not shown in FIG. 1, FIG. 2 and FIG. 3, the angle of footrest pan 84 could be adjustable. In the preferred embodiment, footrest pan 84 is best positioned when it is generally parallel to seatrest 50. Footrest assembly 80 is designed to transfer significant loads into frame 20 so that an occupant can push against footrest pan 84 when extending backrest 60 along backrest tracks 26A and 26B. In the alternative, footrest assembly 80 could be mounted to base 12. However, if footrest assembly 80 were mounted to base 12, more complex position adjustments would be required to compensate for adjustments in base 12 and adjustments in the position of frame 20 in relation to base 12.

As is shown in FIG. 1 and FIG. 3, and shown more clearly in FIG. 2, keyboard table 90 is mounted to backrest 60 so that it can pivot in relation to backrest 60. Keyboard table 90 is carried by an arm 92 that mounts to a collar 94. Collar 94 is mounted to a shaft 96 so that it can moved up and down on shaft 96 and locked into position so that the vertical position of keyboard table 90 can be adjusted. Shaft 96 is carried by two bearings 98A and 98B which allow keyboard table 90 to rotate into and out of the position shown in FIG. 2.

Figure 4:
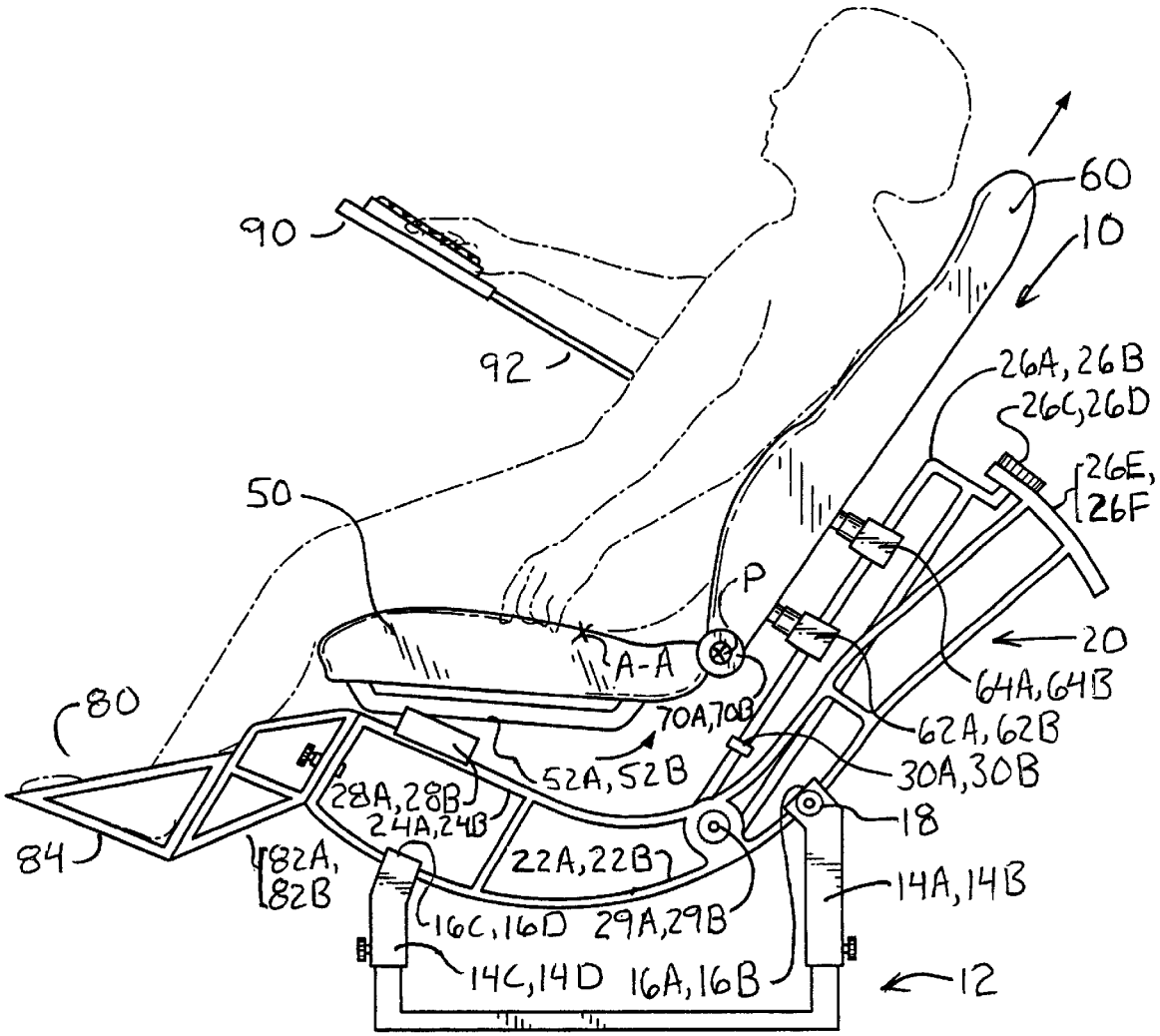
FIG. 4 is a side view of the ergonomic chair of the present invention shown with an occupant and shown in the second extended position with the backrest tracks in a first position parallel to the backrest.

FIG. 4 is a side view of chair 10 in an extended position. As can be seen in FIG. 4, backrest tracks 26A and 26B are in the same position as shown in FIG. 1 and FIG. 2. Seatrest 60 in FIG. 4 is in a fully extended position. In FIG. 4, lower linear bearings 62A and 62B and upper linear bearings 64A and 64B have translated along backrest tracks 24A 26A and 26B. Seatrest tracks 52A and 52B have slid within slotted fittings 28A and 28B attached to inner members 24A and 24B of frame 20 allowing seatrest 50 to rotate and translate relative to frame 20 while pivoting at joints 70A and 70B relative to backrest 60. In this position, the occupant of the chair is pressing up and against backrest 60 and is placing very little pressure on seatrest 50.

FIG. 5. is a side view of chair 10 in an extended position where backrest tracks 26A and 26B have been adjusted and locked in a lower position. In FIG. 5, the telescoping members of lower linear bearings 62A and 62B and upper linear bearings 64A and 64B have extended to accommodate the rotation of backrest tracks 26A and 26B away from backrest 60. Further, the bearings within linear bearings 62A and 62B and upper linear bearings 64A and 64B have rotated in relation their telescoping members to accommodate the relative angular motion between backrest tracks 26A and 26B and backrest 60.

Figure 3A:
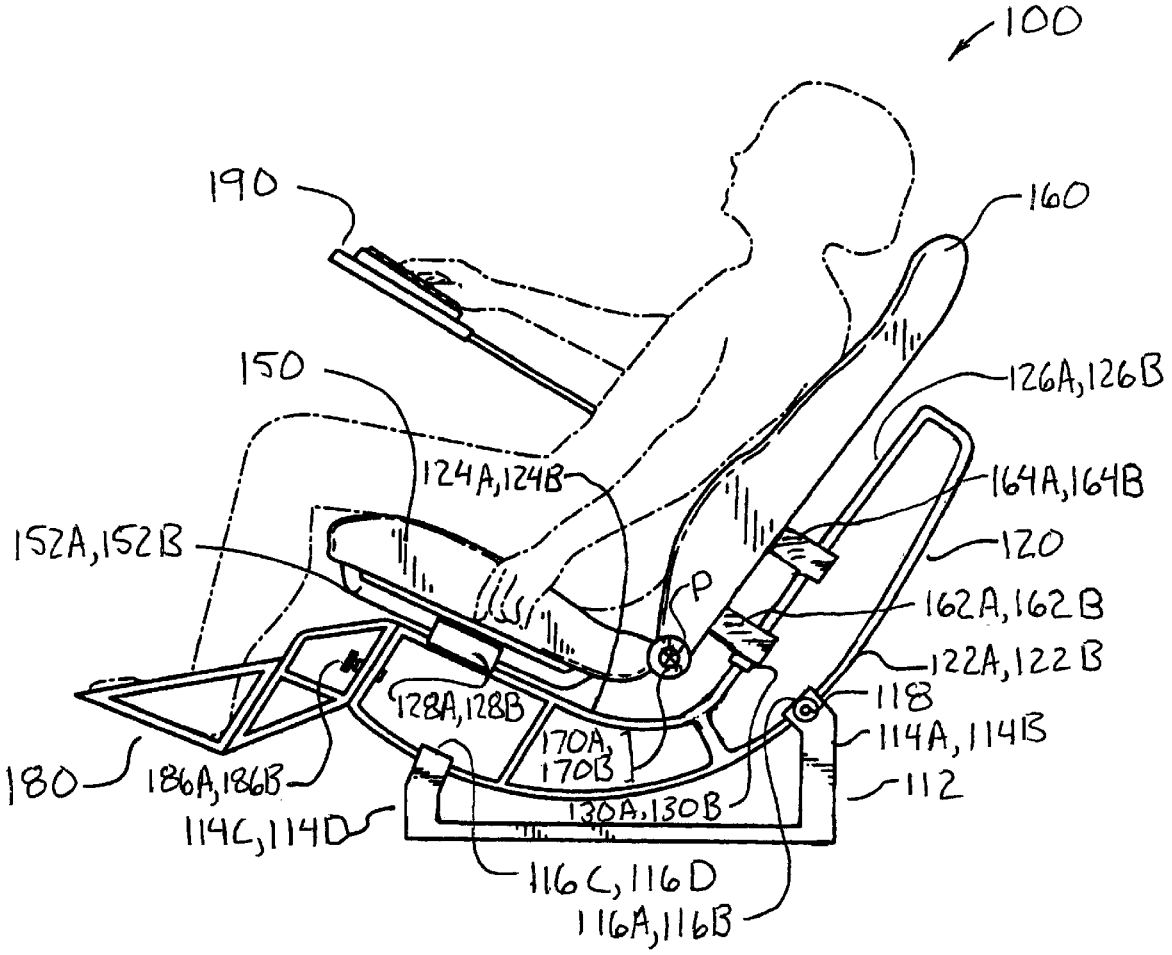
FIG. 3A is a side view of a second embodiment of the ergonomic chair of the present invention shown with an occupant and shown in the first resting position.

FIG. 3A illustrates a simplified embodiment of the chair of the present invention 100. Chair 100 includes a base 112, a frame 120, a seatrest 150, a backrest 160, a footrest assembly 180 and a keyboard table 190. Base 112 includes four columns 114A, 114B, 114C and 114D which are not adjustable. Frame 120 includes two arc shaped outer members 122A and 122B and two inner members 124A and 124B. Fixed to inner members 124A and 124B of frame 20 are slotted fittings 128A and 128B for receiving seatrest 150. Seatrest 150 includes seatrest tracks 152A and 152B that are adapted to slide within slotted fittings 128A and 128B.

As with chair 10 shown in FIG. 1, FIG. 2 and FIG. 3, seatrest 150 of chair 100 shown in FIG. 3 FIG. 3A and backrest 160 are connected to each other by joints 170A and 170B. Joints 170A and 170B are also preferably configured to maintain at least a 90 degree angle between seatrest 150 and backrest 160. Connected to backrest 160 are lower linear bearings 162A and 162B and upper linear bearings 164A and 164B. Lower linear bearings 162A and 162B and upper linear bearings 164A and 164B all slide on a backrest track portions 126A and 126B of inner members 124A and 124B. Backrest stops 130A and 130B fixed to backrest track portions 126A and 126B to prevent lower linear bearings 162A and 162B from sliding below a predetermined point. Lower linear bearings 162A and 162B and upper linear bearings 164A and 164B do not need to be adjustable since backrest 160 and backrest track portions 126A and 126B of inner members 124A and 124B are always parallel.

As is shown in FIG. 3A, base 112 includes four columns 114A, 114B, 114C and 114D which are not shown as telescoping columns. At the top of each of columns 114A, 114B, 114C and 114D are bearings 116A, 116B, 116C and 116D for receiving a portion of outer member 122A or 122B. As with chair 10, arc shaped outer members 122A and 122B can be moved back and forth within bearings 16A, 116B, 116C and 116D to adjust the overall angle of chair 100. At least one bearing lock 118 can be used to lock the position of frame 120 with respect to base 112.

As with chair 10, chair 100 shown in FIG. 3A includes a keyboard table 190 and a footrest assembly 180. Footrest assembly 180 is mounted to seat support frame 120. The position of footrest assembly 180 in relation to frame 20 can be adjusted at adjustable joints 186A and 186B. As with chair 10, Keyboard table 190 of chair 100 shown in FIG. 3A is mounted to backrest 160 so that it can pivot in relation to backrest 160.

Although chair 100 shown in FIG. 3A lacks many of the adjustable features of chair 10 shown in FIG. 1, FIG. 2 and FIG. 3, chair 100 retains features that are important to the present invention. Chair 100 includes backrest 160 and a seatrest 150 that are connected to each other so that they can pivot in relation to each other. With chair 100, backrest 160 are slidably mounted to backrest track portions 126A and 126B of frame 120 so that it can translate between a resting and an extended position. Seatrest 150 is not fixed to frame 120, but is supported by frame 120 so that it can translate and rotate as backrest 160 is moving from a resting to an extended position. These features provide an ergonomic chair that permits an occupant to stretch out and push back against a translating backrest into an extended position while exercising major muscle groups and while continuing to benefit from lower back support from backrest 60.

When properly used by an occupant, either invention chair 10 or invention chair 100 provides a dynamic support that allows the occupant to reinforce optimum alignment of the back and spine. The occupant can periodically extend and flex into a partially or completely raised position with a motion that reinforces proper back and spine alignment. The effect of this capability of movement is to provide a dynamic chair that can be used by an occupant while avoiding much of the lower back stress that usually accompanies being seated for long periods of time.

The invention has been described above in considerable detail in order to comply with the patent laws by providing a full public disclosure of at least one of its embodiments. However, such a detailed description is not intended in any way to limit the broad features or principles of the invention, or the scope of patent monopoly to be granted. The skilled reader, in view of this specification may envision numerous modifications and variations of the above disclosed preferred embodiment. Accordingly, the reader should understand that these modifications and variations, and the equivalents thereof, are within the spirit and scope of this invention as defined in the following claims, wherein.

I claim:

1. An ergonomic chair for supporting a human occupant comprising:

(a) a seatrest and a backrest connected to pivot in relation to each other between a resting position in which the seatrest and the backrest define a first angle and an extended position in which the seatrest and the backrest define a second angle that is larger than the first angle, (b) a seat support frame including a seatrest support for supporting the seatrest, (c) at least one backrest track fixed to the seat support frame, (d) at least one translating member for communication between the backrest and the at least one backrest track, the translating member movable along a path defined by the at least one backrest track between a first resting position add a second extended position, the translating member not locked in any one position between the first resting position and second extended position but free to move therebetween along the at least one backrest track, so that the human occupant of the ergonomic chair may exercise major muscle groups with leg extending movements while pushing the backrest along a path defined by the motion of the translating member along the backrest track as the translating member is moved between the first resting position and the second extended position.

2. The ergonomic chair of claim one further comprising, a base for supporting the seat support frame, the base having a means for height adjustment and means for angle adjustment so that the height and angle of the seat support frame can be adjusted.

3. The ergonomic chair of claim one further comprising, a foot rest assembly fixed to the seat support frame.

4. The ergonomic chair of claim one further comprising, a work table mounted to the backrest.

5. The ergonomic chair of claim one wherein the at least one backrest track is mounted to the seat support frame so that it can be pivoted and locked in a position between a first position and a second position in relation to the seat support frame and wherein the at least one translating member that mounts the backrest to the at least one backrest track is adjustable to accommodate a change in the angle between the backrest and the at least one backrest track so that when the at least one backrest track is pivoted, the backrest can be held in a constant position.

6. An ergonomic chair for supporting a human occupant comprising:

(a) a seatrest and a backrest connected to pivot in relation to each other about a seatrest and backrest pivot axis between a resting position in which the seatrest and the backrest define a first angle and an extended position in which the seatrest and the backrest define a second angle that is larger than the first angle, (b) a seat support frame having a seatrest support for the seatrest, (c) backrest tracks mounted to the seat support frame so that the backrest tracks can pivot at the lower ends thereof and be adjustably fixed in different positions in relation to the seat support frame toward the upper ends thereof, the backrest tracks adjustable between a first position where the backrest tracks define a first angle with the backrest and a second position where the backrest tracks define a second angle with the backrest, (d) translating members for communication between the backrest and the backrest tracks, the translating members movable along paths defined by the backrest tracks between a first resting position a second extended position, the translating members not locked in any one position between the first resting position and the second extended position but free to move therebetween along the backrest tracks so that the human occupant of the ergonomic chair may exercise major muscle groups with leg extending movements while pushing the backrest along a path defined by the motion of the translating members along the backrest tracks as the translating members are moved between the first resting position and the second extended position.

7. The ergonomic chair of claim six wherein, (a) the seat support frame has arc shaped members centered on an axis that is substantially parallel to the seatrest and backrest pivot axis, and (b) the seat support frame supported by a base, the base having fittings for slidably receiving the arc shaped members of the seat support frame where at least one of the fittings can be locked to fix the position of an arc shaped members and the seat support frame in relation to the base, so that the seat support frame can be adjusted between a less reclined and a more reclined position.

8. The ergonomic chair of claim six further comprising, a footrest assembly fixed to the seat support frame.

9. The ergonomic chair of claim six further comprising, a footrest assembly adjustably mounted to the seat support frame.

10. The ergonomic chair of claim six further comprising, a work table mounted to the backrest.

11. An ergonomic chair for supporting a human occupant comprising:

(a) a seatrest and a backrest connected to pivot in relation to each other about a seatrest and backrest pivot axis between a resting position where the backrest and the seatrest define a substantially right angle and an extended position where the backrest and the seatrest define an obtuse angle, (b) a seat support frame including arc shaped members centered on an axis generally parallel to the seatrest and backrest pivot axis, the seat support frame including at least one seatrest support for supporting the seatrest in the resting position, (c) a base for engaging and supporting the seat support frame, the base having fittings for slidably receiving the arc shaped members of the seat support frame where at least one of the fittings can be locked to fix the position of an arc shaped members and the seat support frame in relation to the base, so that the seat support frame can be adjusted between a less reclined and a more reclined position, (d) backrest tracks mounted to the seat support frame so that the backstreet tracks can pivot at the lower ends thereof and be adjustably fixed in relation to the seat support frame at the upper ends thereof, the backrest tracks adjustable between a first position where the backstreet tracks are substantially parallel to the backrest and a second position where the backstreet tracks define an angle with the backrest, (e) translating members for communication between the backrest and the backrest tracks, the translating members movable along paths defined by the backrest tracks between a first resting position a second extended position, the translating members not locked in any one position between the first resting position and the second extended position but free to move therebetween along the backrest tracks so that the human occupant of the ergonomic chair may exercise major muscle groups with leg extending movements while pushing the backrest along a path defined by the motion of the translating members along the backrest tracks as the translating members are moved between the first resting position and the second extended position.

12. The ergonomic chair of claim eleven further comprising, a work table pivotably mounted to the backrest to pivot between a first position rotated away from the backrest and a second position where the worktable is proximate to the backrest.

13. The ergonomic chair of claim eleven wherein, the base includes adjustments for changing the vertical location of the fittings engaging the arc shaped outer members of the seat support frame. A marked up version of claim fourteen is given below to show the nature of this revision.

14. The ergonomic chair of claim eleven further comprising a footrest assembly that is adjustably mounted to the seat support frame.

15. The ergonomic chair of claim eleven further comprising, (a) a work table pivotably mounted to the backrest to pivot between a first position rotated away from the backrest and a second position where the worktable is proximate to the backrest, and, (b) adjustments for changing the vertical location of the fittings of the base that engage the arc shaped members of the seat support frame.

16. The ergonomic chair of claim eleven further comprising, (a) a work table pivotably mounted to the backrest to pivot between a first position rotated away from the backrest and a second position where the worktable is proximate to the backrest, (b) adjustments for changing the vertical location of the fittings of the base that engage the arc shaped members of the seat support frame, and, (c) a footrest assembly mounted to the seat support frame having adjustments for changing the position of the footrest in relation to the seat support frame.

* * * * *